US009478345B2

(12) United States Patent
Fischer et al.

(10) Patent No.: US 9,478,345 B2
(45) Date of Patent: Oct. 25, 2016

(54) CONVERTER UNIT, PARTICULARLY A COMBINATION CONVERTER

(71) Applicant: Siemens Aktiengesellschaft, München (DE)

(72) Inventors: Walter Fischer, Muehldorf am Inn (DE); Markus Gross, Poppenricht (DE); Volker Muhrer, Fuerth (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/895,502

(22) PCT Filed: Mar. 4, 2014

(86) PCT No.: PCT/EP2014/054154

§ 371 (c)(1),
(2) Date: Dec. 3, 2015

(87) PCT Pub. No.: WO2014/202238

PCT Pub. Date: Dec. 24, 2014

(65) Prior Publication Data

US 2016/0118175 A1 Apr. 28, 2016

(30) Foreign Application Priority Data

Jun. 21, 2013 (DE) ..... 10 2013 211 811

(51) Int. Cl.
*H01F 27/02* (2006.01)
*H01F 27/32* (2006.01)
(Continued)

(52) U.S. Cl.
CPC ..... *H01F 27/022* (2013.01); *H01F 27/02* (2013.01); *H01F 27/2823* (2013.01);
(Continued)

(58) Field of Classification Search
CPC ..... H01F 27/00–27/30
USPC ..... 336/90, 92, 96, 225, 229, 220–223, 336/210–213
See application file for complete search history.

(56) References Cited

U.S. PATENT DOCUMENTS 4,164,619 A 8/1979 Sprengling et al.
4,611,191 A 9/1986 Souchere
(Continued)

FOREIGN PATENT DOCUMENTS

DE 731881 C 2/1943
DE 3701037 A1 7/1987
(Continued)

OTHER PUBLICATIONS

International Search Report PCT/ISA/210 for International Application No. PCT/EP2014/054154 dated Jul. 2, 2014.
(Continued)

*Primary Examiner* — Tuyen Nguyen
(74) *Attorney, Agent, or Firm* — Harness, Dickey & Pierce, P.L.C.

(57) ABSTRACT

A converter unit includes: a housing with a moulded-on hollow cylinder that extends into the housing; a non-magnetic toroidal core supporting a first secondary winding, contacting the housing bottom concentrically with the hollow cylinder and is embedded in a solid compound; a magnetic toroidal core supporting a second secondary winding, arranged concentrically with the hollow cylinder above the non-magnetic toroidal coil; and a casting compound with which the housing opening is closed. To achieve a compact converter unit, a first planar spacing element is arranged between the first and the second secondary windings, directly contacting the first secondary winding and the second secondary winding. In addition, electrically insulating particles fill out the space between the second secondary winding and the housing wall, and the casting compound extends at least up to the particles, which lie at the top towards the housing opening.

16 Claims, 3 Drawing Sheets

(51) Int. Cl.

| | |
|---|---|
| ***H01F 38/30*** | (2006.01) |
| ***H01F 27/28*** | (2006.01) |
| *H01F 38/14* | (2006.01) |

(52) U.S. Cl.

CPC ..... *H01F 27/32* (2013.01); *H01F 38/30* (2013.01); *H01F 27/327* (2013.01); *H01F 38/14* (2013.01); *H01F 2038/305* (2013.01)

(56) References Cited

U.S. PATENT DOCUMENTS

| | | | |
|---|---|---|---|
| 4,806,896 | A | 2/1989 | Shikano et al. |
| 5,659,251 | A | 8/1997 | Wakamatsu |
| 5,793,214 | A | 8/1998 | Wakamatsu |
| 6,191,673 | B1 | 2/2001 | Ogura et al. |
| 6,198,373 | B1 | 3/2001 | Ogawa et al. |
| 2007/0052510 | A1 | 3/2007 | Saegusa et al. |
| 2009/0322358 | A1 | 12/2009 | Imaizumi |
| 2013/0002384 | A1 | 1/2013 | Tokota et al. |

FOREIGN PATENT DOCUMENTS

| | | | |
|---|---|---|---|
| EP | 0690310 | A2 | 1/1996 |
| GB | 2013040 | A | 8/1979 |
| GB | 2329762 | A | 3/1999 |
| JP | H1167519 | A | 3/1999 |
| WO | WO-0055234 | A1 | 9/2000 |

OTHER PUBLICATIONS

Written Opinion of the International Searching Authority PCT/ISA/237 for International Application No. PCT/EP2014/054154 dated Jul. 2, 2014.

CONVERTER UNIT, PARTICULARLY A COMBINATION CONVERTER

PRIORITY STATEMENT

This application is the national phase under 35 U.S.C. §371 of PCT International Application No. PCT/EP2014/054154 which has an International filing date of Mar. 4, 2014, which designated the United States of America and which claims priority to German patent application number DE102013211811.2 filed Jun. 21, 2013, the entire contents of which are hereby incorporated herein by reference.

FIELD

An embodiment of the invention generally relates to a converter unit, in particular a combination converter having one converter for measuring current and one converter for supplying current in a common housing.

BACKGROUND

Combination converters with a first secondary winding, which is wound onto a non-magnetic annular core, and a second secondary winding, which is wound on a magnetic annular core (iron core), are known. In this case, both secondary windings are arranged in a common housing which has a pot shape with a hollow passage cylinder integrally formed on the housing floor. In this case, the first secondary winding serves to measure current (converter for measuring current) and the second secondary winding serves to supply current (converter for supplying current), wherein one current conductor is routed through the hollow passage cylinder and the annular cores and forms the primary winding of the converters. The magnetic annular core is preferably composed of soft iron.

Current converters for circuit breakers have to have a high dielectric strength, that is to say correspondingly long air and creepage paths. These are required, in particular, in order to withstand the so-called surge or EMC testing.

In order to achieve a high dielectric strength, it is known, in principle, to embed the two secondary windings into an encapsulation compound and to route the connection wires of the windings through the encapsulation compound to the outside. The encapsulation compound in the form of insulation means has to be appropriately certified for industrial use.

Nowadays, particularly in the case of current converters for circuit breakers, it is often necessary for said current converters to be free of silicone in order to avoid the precipitation (evaporation) phenomena which occur with silicone under certain conditions.

Therefore, possible encapsulation compounds often include only resins, in particular resins which are composed of two components, that is to say epoxy resins. However, said resins have the disadvantage that there is a loss of volume when the encapsulation compound is chemically cross-linked, this being associated with pressure on the windings which reduces, in particular, the permeability of the iron core when said iron core is composed of soft iron.

Current converters for circuit breakers further need to be designed for a large operating temperature range (for example of −25° C. to approximately 180° C.). It is sometimes necessary to ensure a storage temperature of up to −40° C. In fact, cracks occur in the encapsulation compound specifically at relatively high temperatures around 180° C. in the case of resins, said cracks, in turn, forming undesired creepage paths.

SUMMARY

At least one embodiment of the invention is directed to a particularly compact (that is to say physically small) converter unit having a magnetic and a non-magnetic annular core which has a high dielectric strength (high-voltage strength) over a relatively large temperature range, a high degree of efficiency during energy conversion and allows interruption-free current measurement.

The independent and dependent claims constitute advantageous refinements.

At least one embodiment of the invention makes provision for a first flat spacer element to be arranged between the first secondary winding and the second secondary winding, wherein said first flat spacer element bears directly against the first secondary winding by way of one flat face and bears directly against the second secondary winding by way of the other flat face, for electrically insulating particles, as seen in the radial direction, to fill the space between the second secondary winding and the housing wall at least as far as the top face of the second secondary winding, and for the encapsulation compound to bear at least against the particles (to extend at least as far as the particles) which lie at the top in the direction of the housing opening. In this case, (firmly) bearing against the particles and against the housing wall means an intimate contact connection, as occurs in the case of an adhesive connection and the like. Furthermore, "bear at least against the particles" means corresponding contact with the upper portion of the surfaces of the particles which lie at the top.

BRIEF DESCRIPTION OF THE DRAWINGS

The invention will be described in greater detail below with reference to an exemplary embodiment, in which.

DETAILED DESCRIPTION OF THE EXAMPLE EMBODIMENTS

At least one embodiment of the invention makes provision for a first flat spacer element to be arranged between the first secondary winding and the second secondary winding, wherein said first flat spacer element bears directly against the first secondary winding by way of one flat face and bears directly against the second secondary winding by way of the other flat face, for electrically insulating particles, as seen in the radial direction, to fill the space between the second secondary winding and the housing wall at least as far as the top face of the second secondary winding, and for the encapsulation compound to bear at least against the particles (to extend at least as far as the particles) which lie at the top in the direction of the housing opening. In this case, (firmly) bearing against the particles and against the housing wall means an intimate contact connection, as occurs in the case of an adhesive connection and the like. Furthermore, "bear at least against the particles" means corresponding contact with the upper portion of the surfaces of the particles which lie at the top.

It is technically simple when the particles cover the top face of the second secondary winding by way of a particle layer which has a thickness which amounts to several average particle diameters.

It is advantageously proposed that the particles are embedded in the encapsulation compound starting from the top face of the particle layer only down to a depth of several average particle diameters, wherein the depth is less than the thickness of the particle layer.

The converter unit is even more compact when the top face of the second secondary winding is covered by a film or foil, and the encapsulation compound extends a) as far as the top face of the film or foil, and b) as far as the particles which are located on the sides of the film or foil and are located at the top in the direction of the housing opening and lie substantially in one plane with the film or foil.

It is technically expedient when particles which are located on the sides of the film or foil and lie at the top in the direction of the housing opening and in one plane with the film or foil are embedded in the encapsulation compound.

A simple embodiment makes provision for the particles to be of spherical design.

Spherical particles which are highly suitable from an electrical point of view are in the form of glass balls.

Production can be simplified when a second flat spacer element bears against the film or foil by way of one flat face and at least partially covers said film or foil.

Figure 1:
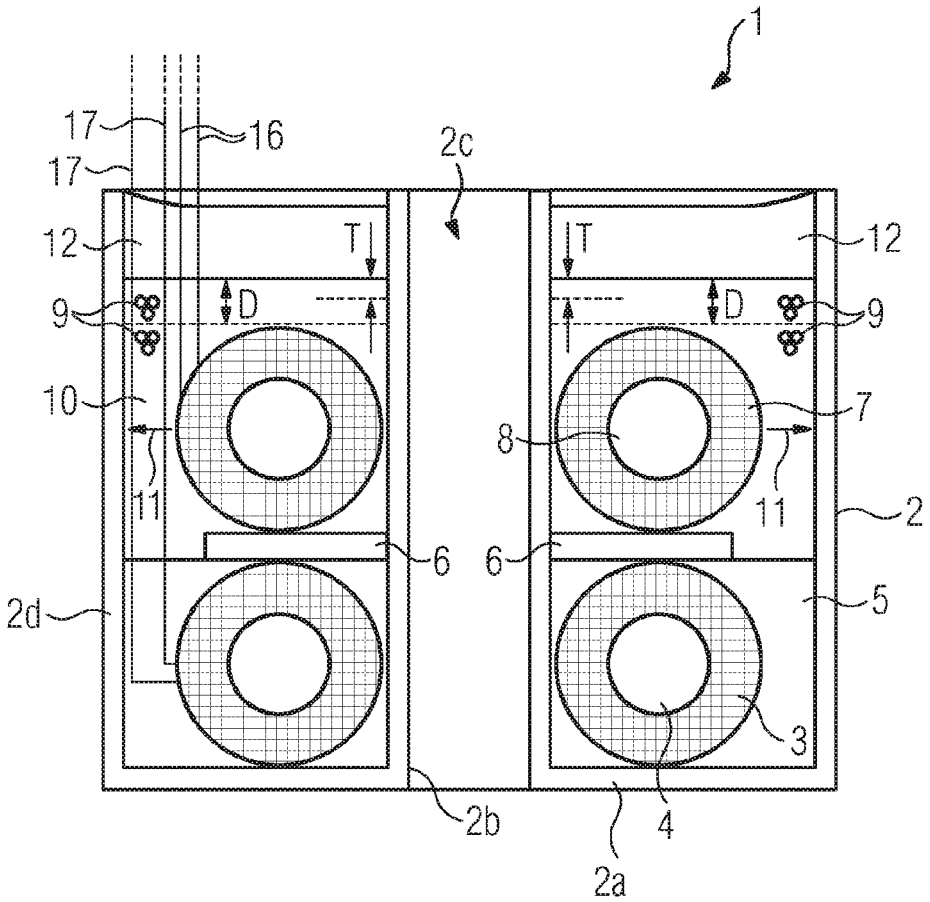
FIG. 1 shows a cross section through a converter unit having a particle layer above the top secondary winding.

FIG. 1 shows a schematic cross section through a converter unit 1 (combination current converter) for a circuit breaker (not shown) which is supplied by the converter unit 1 with electrical energy and with a signal for measuring current.

The converter unit 1 has a housing 2 with a pot shape which is composed of an electrically insulating plastic. A hollow (passage) cylinder 2*b* (generally a passage channel 2*c*) is integrally formed on the housing floor 2*a*, a current conductor (not shown) in the form of a primary conductor (primary winding) of the converter unit 1 running through said hollow (passage) cylinder. In this case, the plastic has, by way of example, an insulating capacity of approximately 20-30 kV/mm.

A (first) secondary winding 3 lies on the housing floor 2*a*, said (first) secondary winding being arranged concentrically in relation to the hollow cylinder 2*b* and being wound onto a non-magnetic annular core 4 (Rogowski converter for measuring current). The secondary winding 3 is embedded in an electrically insulating solid plastic compound 5. It goes without saying that the secondary winding 3 may also be a single annular coil which is wound around the annular core 4.

A flat spacer element 6 in the form of a perforated disk lies directly on top of the secondary winding 3 by way of its lower flat face, so that the secondary winding 3 is at least partially covered in a radial manner as seen from the top. There is no plastic compound 5 between the secondary winding 3 and the spacer element 6. In FIG. 1, the secondary winding 3 is completely covered in a radial manner as seen from the top.

A further (second) secondary winding 7 which is wound onto a magnetic annular core 8 (iron core converter for supplying energy) is situated on the top face of the spacer element 6. The spacer element 6 clearly defines the distance between the two secondary windings 3, 7. In this case, the magnetic annular core 8 is composed of soft iron. It goes without saying that the winding 7 may also be a simple annular coil which is wound around the annular core 8.

The secondary winding 7 is completely embedded in electrically insulating loose particles 9 above the spacer element 6. In FIG. 1, the winding 7 is also completely covered by particles 9 in the direction of the top; the cover or the particle layer 10 has a thickness D in this case. In principle, an embedding arrangement in the radial direction 11 is already sufficient. The particles 9 which bear against one another are only schematically illustrated (at the top right) in FIG. 1. In other words: the particles 9 fill the region next to and the region (with the thickness D) above the secondary winding 7 in this case.

The particles 9 are glass balls with a suitable diameter distribution (for example in the form of a Gaussian distribution in this case). However, as an alternative, said particles may also be ceramic powders or ceramic granules, in particular aluminum oxide (Al203) with an average particle size of 300 μm. Cured resin can also be pulverized in principle.

In this case, the thickness D of the particle layer 10 amounts to several average particle diameters.

The region directly adjoining the particle layer 10 is encapsulated with an encapsulation compound 12. In this case, the encapsulation compound 12 bears firmly (intimately) against the inner face of the housing wall 2*d* and at least also against the particles 9 which lie at the top in the direction of the housing opening.

However, proceeding from the top face of the particle layer 10, the particles 9 in FIG. 1 are even embedded in the encapsulation compound 12 down to a depth T of several average particle diameters, wherein the depth T is less than the thickness D of the particle layer 10. In this case, the encapsulation compound 12 bears against the particles 9 (all the way around) virtually down to a depth T and not only in each case against the top face of the particles 9 which lie at the top (at the very top) in the direction of the housing opening.

Figure 2:
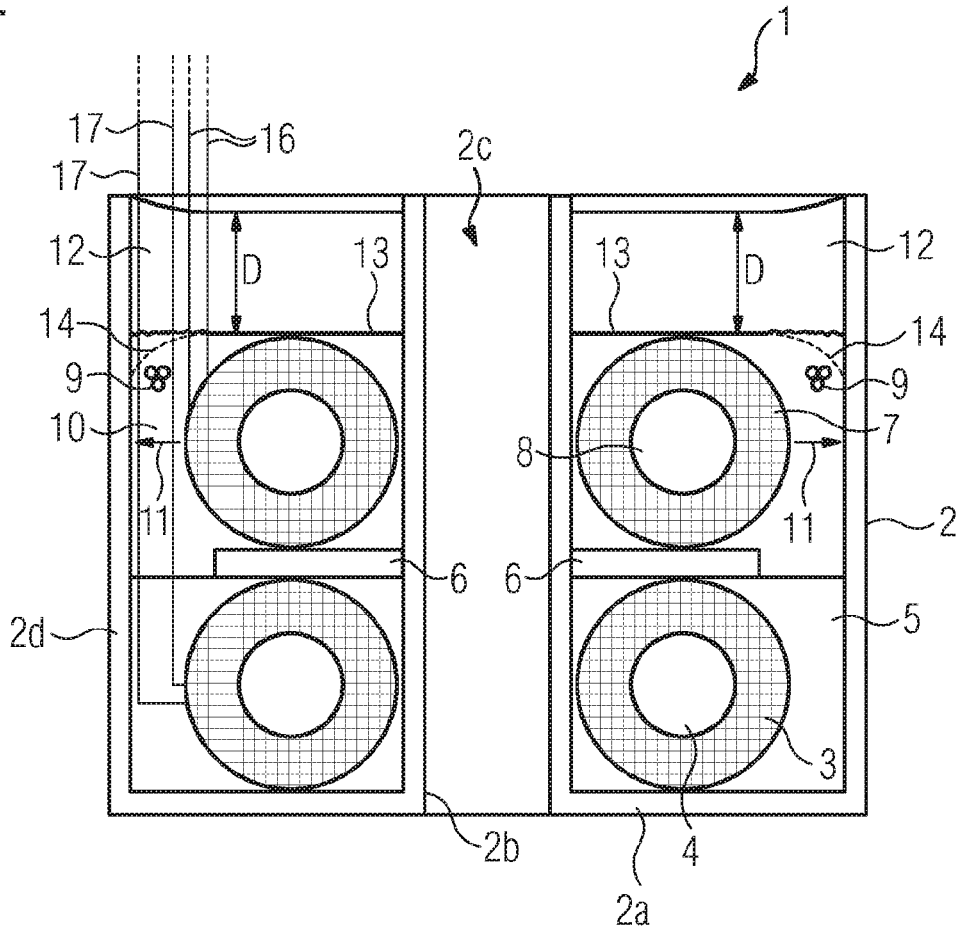
FIG. 2 shows the converter unit according to FIG. 1 with a film or foil above the top secondary winding.

FIG. 2 shows an alternative converter unit 1 in which the top face of the second secondary winding 7 is covered by a thin film or foil 13 instead of by a particle layer 10. The particles 9 which lie at the top in the direction of the housing opening and lie further to the outside as seen in the radial direction and therefore are not covered by the film or foil 13 are located approximately in one plane with the film or foil 13 in FIG. 2. The encapsulation compound 12 now bears firmly (intimately) against the top face of the film or foil 13 and at least against the outer top particles 9 since the film or foil 13 does not extend as far as the inner face of the housing wall 2*d*.

The particles 9 which lie in one plane with the film or foil 13 can likewise be embedded in the encapsulation compound 12 over several average particle diameters, but without the encapsulation compound 12 extending as far as the second secondary winding 7.

In FIG. 2, the particles 9 are embedded in the encapsulation compound 12 over several average particle diameters. The embedding boundary is schematically indicated by the dashed line 14.

Figure 3:
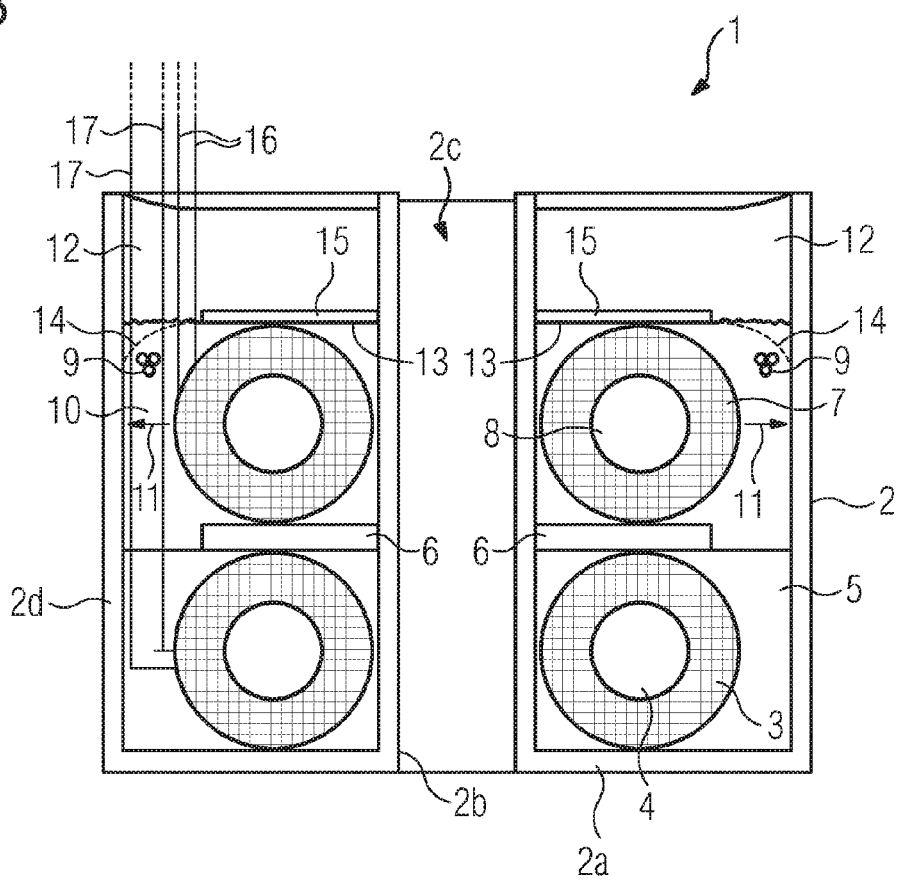
FIG. 3 shows the converter unit according to FIG. 2 having a perforated disk element lying on the film or foil.

FIG. 3 shows a flat perforated disk element 15 which corresponds to the spacer element 6 and which lies on the film or foil 13 and at least partially covers the secondary winding 7 in the radial direction. Said perforated disk element 15 holds down the secondary winding 7 as the glass balls are filled, that is to say substantially prevents the secondary winding 7 from floating. As an alternative, the film or foil 13 can also lie on the spacer element 6.

The connection wires 16, 17 of the secondary windings 7, 3 are routed through the encapsulation compound 12.

The method for producing the converter unit 1 according to FIG. 1 (and accordingly FIGS. 2 and 3) comprises the following steps:

the secondary winding 3 is inserted into the housing 4, the spacer element 6 is then pushed onto the secondary winding 3, the plastic compound 5 is then introduced, wherein the top face of the spacer element 6 remains free of plastic compound 5, the secondary winding 7 is then inserted into the housing 4, so that said secondary winding comes to rest on the top face of the spacer element 6, the particles 9 are then introduced, so that the secondary winding 7 is surrounded by the particles 9 radially and from above and is embedded in said particles, and the housing 4 which is open at the top is then encapsulated using the encapsulation compound 12, the flow properties of said encapsulation compound ensuring that the encapsulation compound 12 enters the particle layer 10 only down to a depth T of several average particle diameters, wherein encapsulation is performed by means of a vacuum encapsulation system in order to avoid air pockets.

The invention claimed is:

1. A converter unit comprising:

an electrically insulating pot-shaped housing including, at the bottom, a housing floor and a hollow cylinder, arranged on the housing floor and extending upward into the interior of the housing;

a non-magnetic annular core, supporting a first secondary winding lying on the housing floor concentrically in relation to the hollow cylinder and is embedded in a solid compound;

a magnetic annular core, supporting a second secondary winding and arranged concentrically in relation to the hollow cylinder above the non-magnetic annular core; and an electrically insulating solidified encapsulation compound which closes the housing opening, wherein the encapsulation compound bears against the housing wall to be firmly connected to the inner face of the housing wall; and a first flat spacer element, arranged between the first secondary winding and the second secondary winding, said first flat spacer element bearing directly against the first secondary winding by way of one flat face and bearing directly against the second secondary winding by way of the other flat face, wherein electrically insulating particles, as seen in the radial direction, fill the space between the second secondary winding and the housing wall at least as far as the top face of the second secondary winding, and wherein the electrically insulating solidified encapsulation compound extends at least as far as the particles lying at the top in the direction of the housing opening.

2. The converter unit of claim 1, wherein the particles cover the top face of the second secondary winding by way of a particle layer which includes a thickness which amounts to several average particle diameters.

3. The converter unit of claim 2, wherein the particles are embedded in the encapsulation compound starting from the top face of the particle layer down to a depth of several average particle diameters, and wherein the depth is less than the thickness of the particle layer.

4. The converter unit of claim 1, wherein the top face of the second secondary winding is covered by a film or foil, and wherein the encapsulation compound bears against the top face of the film or foil, and bears against the particles located on the sides of the film or foil and located at the top in the direction of the housing opening and lie in one plane with the film or foil.

5. The converter unit of claim 4, wherein the particles located on the sides of the film or foil and lying at the top in the direction of the housing opening and in one plane with the film or foil are embedded in the encapsulation compound.

6. The converter unit of claim 5, wherein the embedded arrangement does not extend as far as the second secondary winding.

7. The converter unit of claim 1, wherein the particles are of spherical design.

8. The converter unit of claim 7, wherein the particles are in the form of glass balls.

9. The converter unit of claim 4, wherein a second flat perforated disk element bears against the film or foil by way of one flat face and at least partially covers said film or foil.

10. The converter unit of claim 2, wherein the top face of the second secondary winding is covered by a film or foil, and wherein the encapsulation compound bears against the top face of the film or foil and bears against the particles located on the sides of the film or foil and located at the top in the direction of the housing opening and lie in one plane with the film or foil.

11. The converter unit of claim 10, wherein the particles located on the sides of the film or foil and lying at the top in the direction of the housing opening and in one plane with the film or foil are embedded in the encapsulation compound.

12. The converter unit of claim 11, wherein the embedded arrangement does not extend as far as the second secondary winding.

13. The converter unit of claim 5, wherein a second flat perforated disk element bears against the film or foil by way of one flat face and at least partially covers said film or foil.

14. The converter unit of claim 6, wherein a second flat perforated disk element bears against the film or foil by way of one flat face and at least partially covers said film or foil.

15. The converter unit of claim 7, wherein a second flat perforated disk element bears against the film or foil by way of one flat face and at least partially covers said film or foil.

16. The converter unit of claim 8, wherein a second flat perforated disk element bears against the film or foil by way of one flat face and at least partially covers said film or foil.

* * * * *